US005368377A

United States Patent [19]

Baines

[11] Patent Number: 5,368,377

[45] Date of Patent: Nov. 29, 1994

[54] FLIP-TOP COMPUTER WORKSTATION

[75] Inventor: Edward A. Baines, Covina, Calif.

[73] Assignee: Continental Engineering Group, Inc., Irwindale, Calif.

[21] Appl. No.: 976,910

[22] Filed: Nov. 16, 1992

[51] Int. Cl.[5] ..... A47B 81/00

[52] U.S. Cl. ..... 312/27; 312/194

[58] Field of Search ..... 312/194, 196, 311, 27, 312/223.2, 208.3; 108/23, 33; 248/918, 914

[56] References Cited

U.S. PATENT DOCUMENTS

| | | | |
|---|---|---|---|
| 1,599,351 | 9/1926 | Teetsel | 312/27 |
| 1,850,487 | 3/1932 | Young | 312/27 |
| 4,562,482 | 12/1985 | Brown | 358/254 |
| 4,590,866 | 5/1986 | Schairbaum | 108/23 |
| 4,669,789 | 6/1987 | Pemberton | 312/7.2 |
| 4,695,104 | 9/1987 | Lederman | 312/223.3 |
| 4,755,009 | 7/1988 | Price | 312/194 |
| 4,828,342 | 5/1989 | Stefan | 312/21 |
| 5,094,514 | 3/1992 | Grosch | 312/194 |
| 5,199,773 | 4/1993 | Price | 312/194 |

FOREIGN PATENT DOCUMENTS

| | | | |
|---|---|---|---|
| 1106895 | 8/1981 | Canada . | |
| 248100 | 6/1986 | European Pat. Off. . | |
| 2480581 | 10/1981 | France . | |
| 8606575 | 11/1986 | Germany . | |
| 8625144 | 6/1987 | Germany . | |
| 8906248 | 8/1989 | Germany . | |
| 659370 | 2/1983 | Liechtenstein . | |
| 841553 | 7/1960 | United Kingdom | 312/27 |
| 2172498 | 9/1986 | United Kingdom . | |
| 2215197 | 9/1989 | United Kingdom . | |

OTHER PUBLICATIONS

*Global* Catalog, p. 120, High Tech See Thru II (upper right hand corner of.

*Primary Examiner*—Flemming Saether
*Attorney, Agent, or Firm*—Christie, Parker & Hale

[57] ABSTRACT

A computer workstation is formed in the shape of a desk and has an extendible and retractable keyboard shelf and an inclined adjustable monitor supporting shelf. The workstation has a flat desktop surface, which has a door formed in it. When the keyboard shelf is extended, the door automatically rotates upward. When the keyboard shelf is fully extended, the open door fully reveals the screen of the computer monitor mounted on the monitor supporting shelf. When the keyboard shelf is retracted, the door automatically closes, returning the desktop surface to its normal flat shape. Two pivotable linkage arms are mounted to the desktop surface at each side of the door, and each have one end that passes through a slotted plate fixed to the keyboard shelf and another end that engages the underside of the door. Extending the keyboard shelf causes the linkage arms to rotate and cam the door open. Retracting the keyboard shelf causes the linkage arms to rotate in an opposite direction and allow the door to close through the force of gravity.

9 Claims, 6 Drawing Sheets

10
22
28
4
15
24
20
14
12
16
24
8

FLIP-TOP COMPUTER WORKSTATION

BACKGROUND OF THE INVENTION

The present invention relates to a flip-top computer workstation and, more specifically, to a computer workstation that fits in a desk such that the desk has a flat work surface when the computer is not in use, and when the computer keyboard is pulled out, a door in the desktop opens to reveal a computer monitor.

Typically, computer monitors and keyboards are placed on top of a desk when there is no room to use a separate workstation, or to avoid the expense of such a workstation. However, the keyboard and monitor take up a lot of desk surface space. Computer workstations having a shelf for supporting a keyboard which slides on a track and a monitor supporting shelf which is tiltable (such as glass top workstations) are well known. However, due to glare problems caused by the glass, such workstations may not be desirable to some users. Therefore, it is desirable to integrate a desk and a computer workstation, yet still maintain maximum surface space at low cost and without glare.

SUMMARY OF THE INVENTION

The invention provides a computer workstation in the form of a desk. The desk has a top surface with an opening defined in it and a rotatable door mounted in the opening. Below the desk surface, there is a keyboard shelf slidably mounted to the desk for movement between a retracted position, where the keyboard shelf is under the desktop, and an extended position, where the keyboard shelf is extended from the desk. A monitor shelf is mounted to the desk under the opening. Preferably, the monitor shelf is adjustable in tilt. The keyboard shelf and door in the desktop are connected by linkage arms such that when the keyboard shelf is extended, the linkage arms open the door to reveal the screen of the monitor, and when the keyboard shelf is retracted, the linkage arms allow the door to close. Accordingly, the workstation has a flat desk surface when the computer is not in use.

DESCRIPTION OF THE PREFERRED EMBODIMENTS

Figure 1:
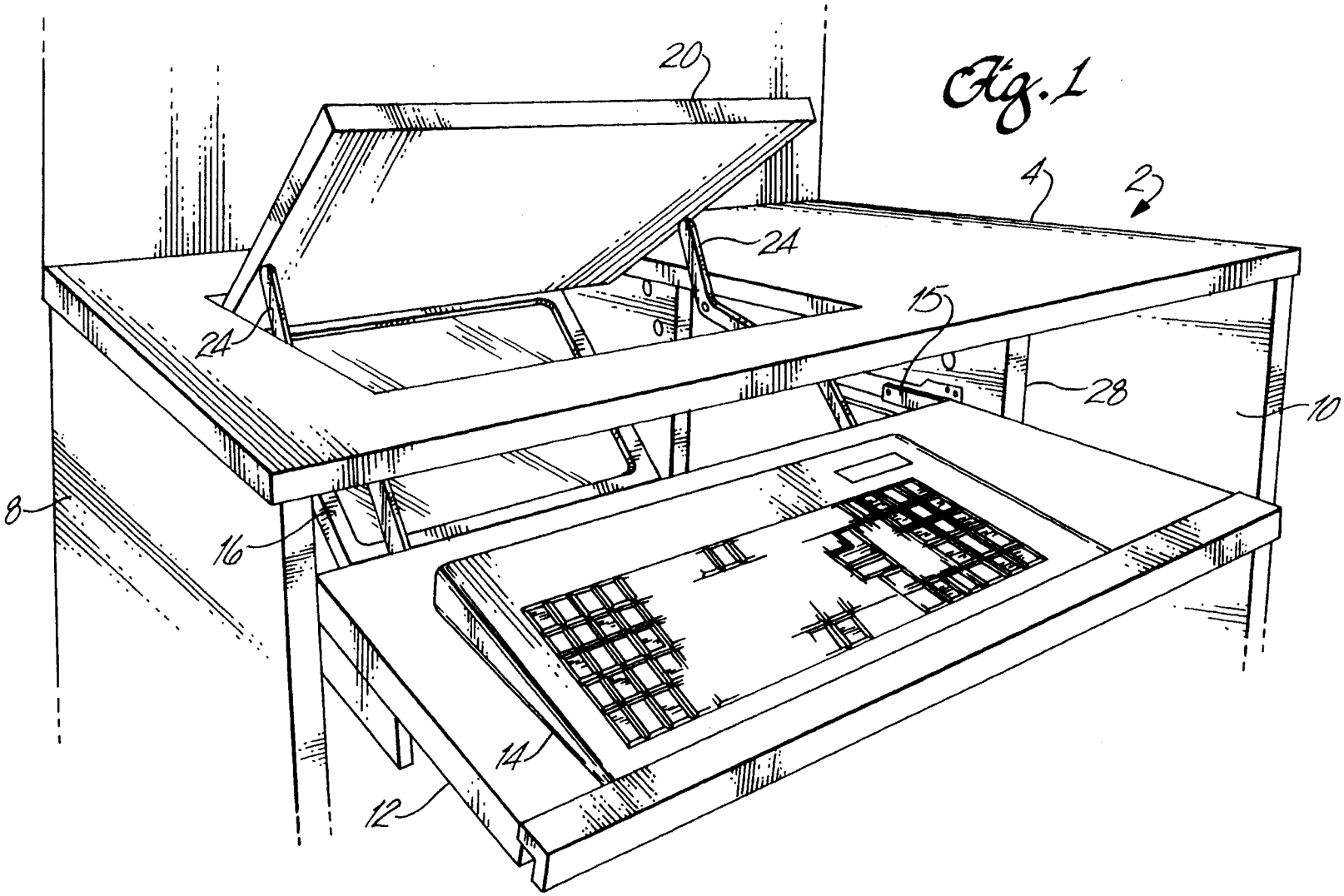
FIG. 1 is a front perspective view of a computer workstation in accordance with the invention.

With reference to FIG. 1, a computer workstation 2 is in the form of a desk having a top work surface 4 and two supporting sidewalls 8, 10. The desk may also have a modesty panel (not shown). A slidable keyboard shelf 12 supports a keyboard 14. Shelf 12 is slidable on a track 15, as is well known in the art. A monitor shelf (not shown in FIG. 1) holds a computer monitor 16. Preferably, the desk has other shelves for mounting a CPU, a printer, and other peripherals, as needed.

The top surface of the desk has an opening formed in it in which a door/hatch 20 is disposed. A middle leg or panel 28 receives one part of track 15, and sidewall 8 receives the other.

Figure 2:
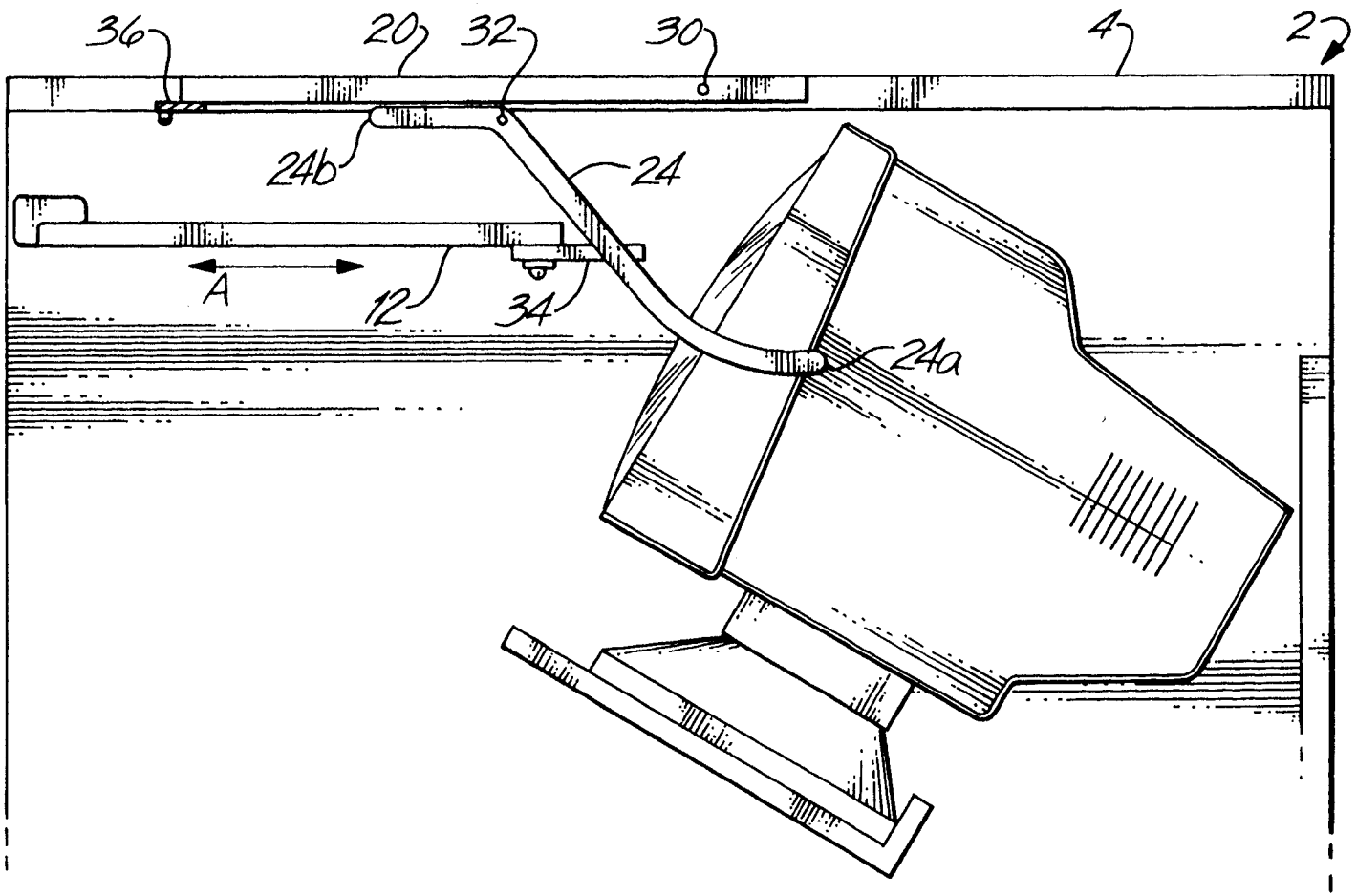
FIG. 2 is a side view of part of the workstation showing a keyboard shelf in a retracted position and a door in the desktop in a closed position.
Figure 3:
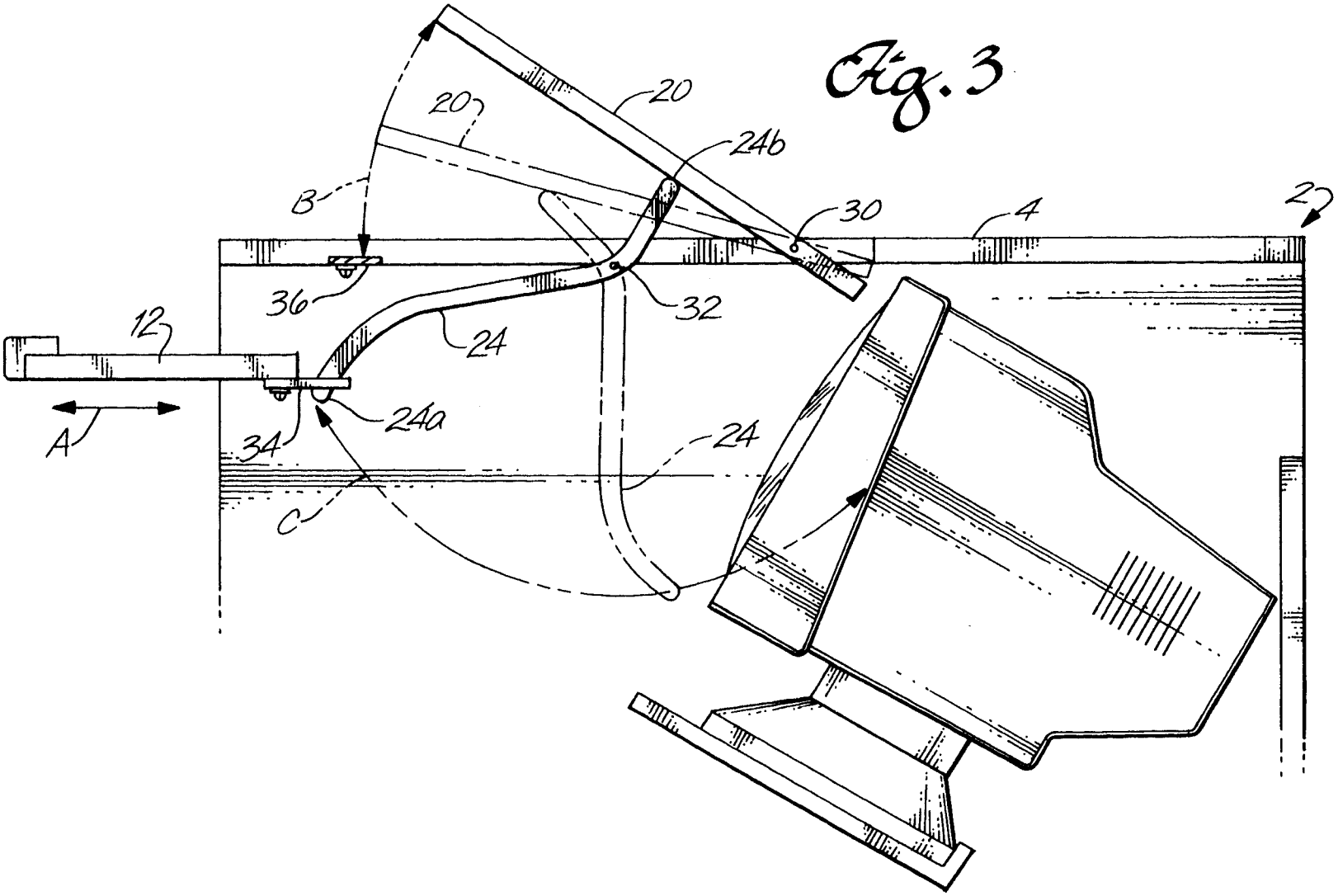
FIG. 3 is a view similar to that of FIG. 2, but with the keyboard shelf in an extended position and the door in an open position.

With reference to FIGS. 2 and 3, which show door 20 in closed and open position, respectively, door 20 moves in response to movement of keyboard shelf 12. When the computer is not in use, the flat desktop 4 serves as a work space.

Keyboard shelf 12 is movable in opposite directions shown by arrow A, and door 20 is movable in response thereto in directions along arc B. Door 20 is connected to shelf 12 by two linkage arms 24 which pivot along an axis 32. The linkage arms each have a first end 24*a* and a second end 24*b*. Each first end passes through a respective plate 34 fixed to the keyboard shelf, and each second end engages the underside of door 20. A slot may be provided in the underside of door 20 for receiving each second end.

When the keyboard shelf is extended as shown in FIG. 3, each arm 24 is pulled, by means of each respective plate 34, along with the keyboard. Thus, each arm rotates clockwise about pivot point 32. Rotation of each arm 24 causes each second end 24*b* to cam door 20 so that it rotates open. Retracting keyboard shelf 12 pushes each end 24*a* of each arm 24 so that the arms rotate counterclockwise about pivot point 32. This causes each end 24*b* to rotate counterclockwise and allow gravity to pull door 20 downward. The frontmost end of door 20 can rest on two plates 36 or one long plate bolted to the underside of desktop surface 4 for extra support. Otherwise, door 20 can just rest on each linkage arm 24.

FIG. 3 also shows an intermediate position of the linkage arm and door in phantom.

Figure 4:
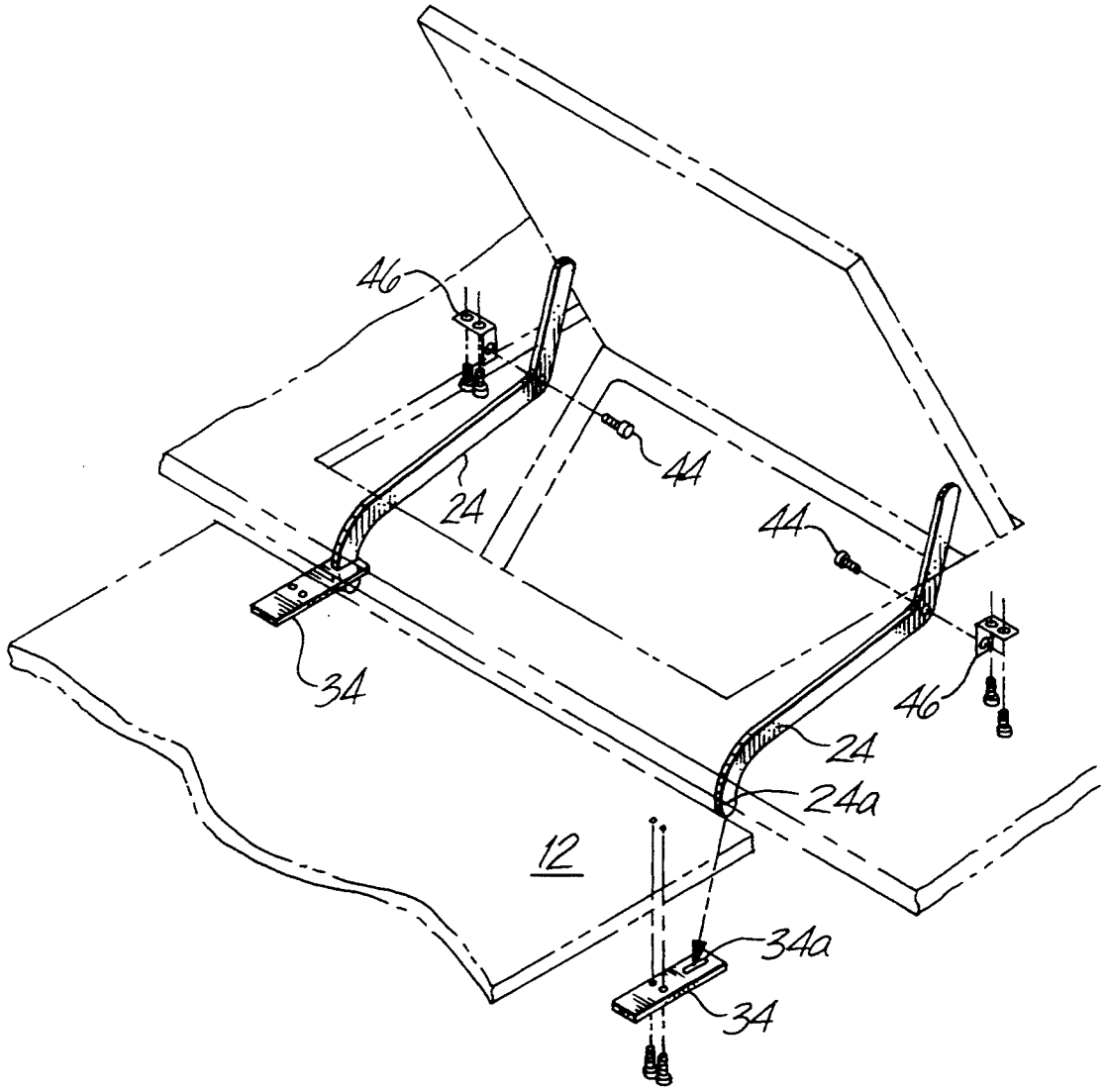
FIG. 4 is a perspective view of part of a keyboard shelf showing an exploded view of connection of a linkage arm to the shelf and to a desktop surface.

FIG. 4 shows details of how each linkage arm 24 is connected to the keyboard shelf 12 and underside of the desktop surface. Specifically, each first end 24*a* of each linkage arm passes through a slot 34*a* formed in slotted plate 34, which is bolted or screwed to the underside of keyboard shelf 12. Slot 34*a* allows first end 24*a* of arm 24 to slide vertically through it so that the pivot arm is free to rotate about pivot point 32. Pivot point 32 is formed by rivets 44 passing through each linkage arm and fastened to an angle 46. Each angle 46 is, in turn, bolted or screwed to the underside of desk surface 4 adjacent the opening in which door 20 is mounted.

Figure 5:
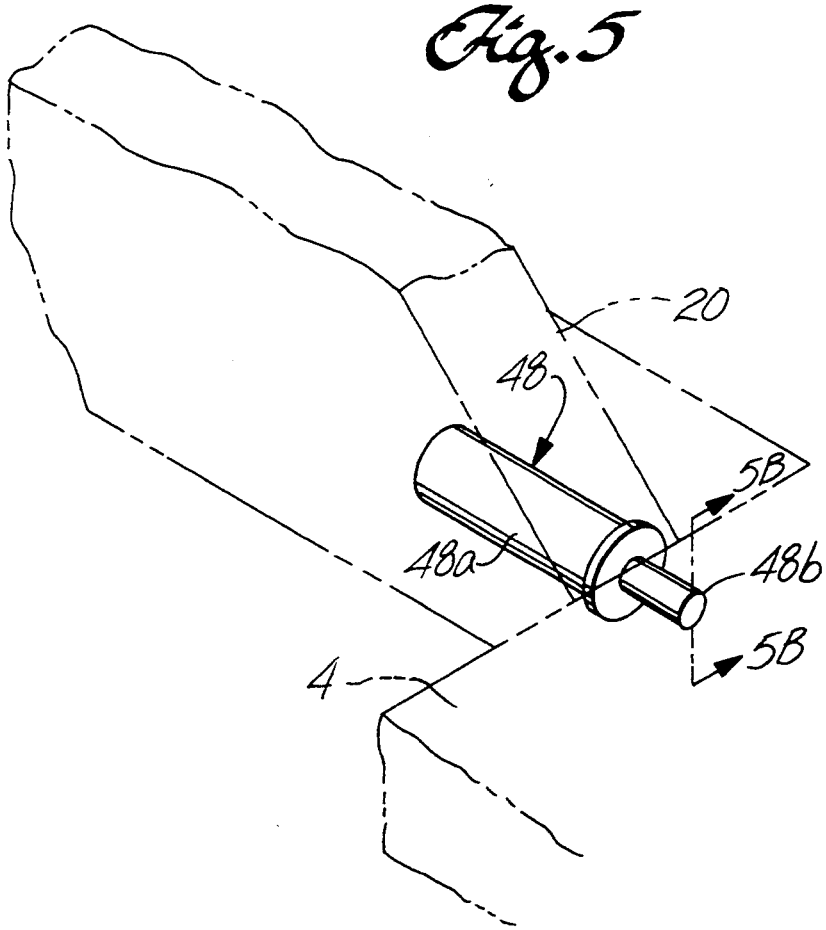
FIG. 5 is a perspective view of one pivot pin for pivotably attaching the door (shown in phantom) to the desktop (shown in phantom)
Figure 6:
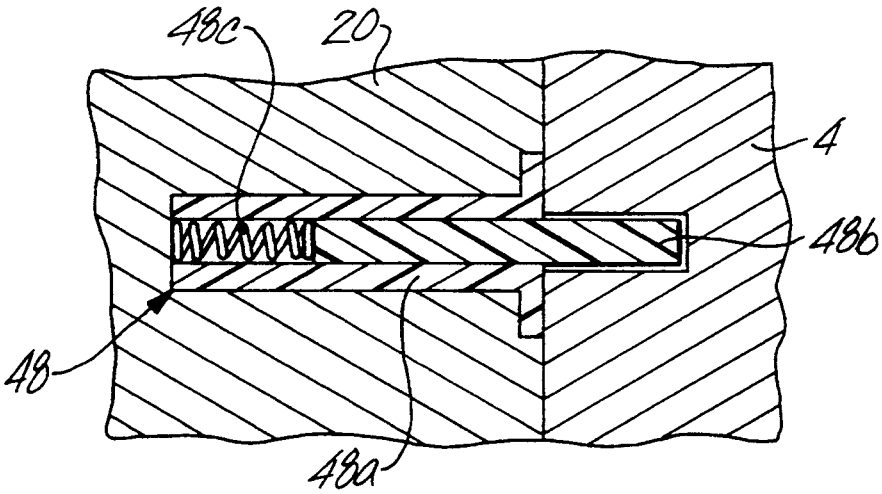
FIG. 6 is a sectional view of a portion of the desktop surface and door in the desktop.

FIGS. 5 and 6 show details of how one pivot point 30 is formed. Near the rear of each side of door 20, a pivot pin 48 is inserted into door 20 by a frictional fit, or otherwise, into a cylindrical bore. Each pin 48 includes an outer sheath 48*a* and a spring pin 48*b*. Spring pin 48*b* retracts during mounting of the door and extends into a corresponding bore formed in the desktop surface to complete mounting of the door. The other pivot point is identically formed.

Figure 7:
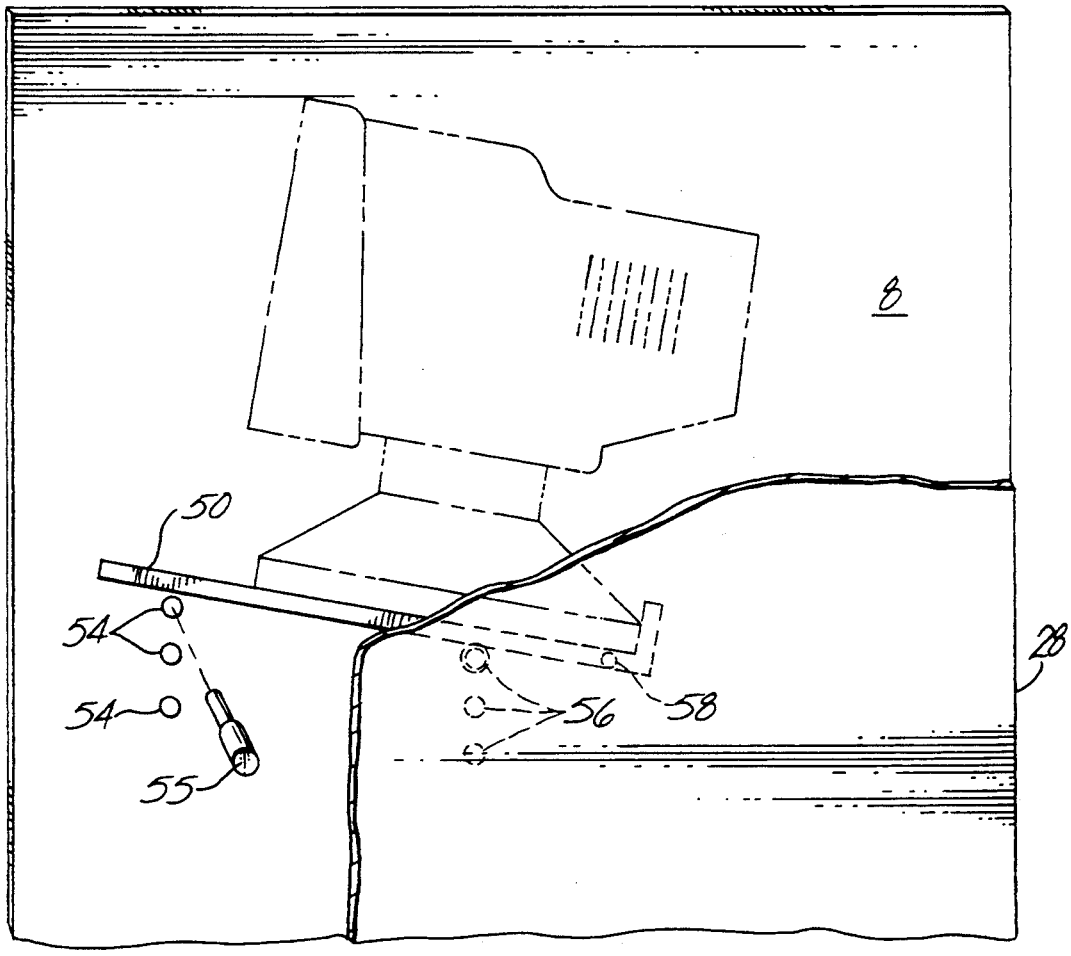
FIG. 7 is a side view showing a monitor shelf and its adjustable tilt connection to a side panel of the workstation and to an intermediate panel of the workstation.

FIG. 7 shows a side view of a monitor shelf 50 and its connection to left side wall 8. Wall 8 has a set of holes aligned vertically or in a small arc pattern. This set of holes is shown in solid as reference numeral 54. A standard shelf pin 55, such as a space-type shelf pin, is inserted into one of the holes 54. A second set of holes 56 is shown in phantom formed in intermediate or middle panel 28, and another shelf pin may be inserted into a corresponding one of the holes 56. Shelf 50 rests on these pins and thus has its angle set. Shelf 50 is rotatable about a pivot point 58, which would, for example, be formed by two pivot pins such as shown in FIG. 5, one in sidewall 8 and one in the middle panel 28. If the middle panel extends far enough, the second set of holes may be formed opposite the first set of holes 54.

It should be noted that door 20 should be sufficiently large so that when it is opened, the entire screen of a standard monitor can be viewed by someone sitting at the desk in front of the keyboard shelf. The keyboard shelf should be centered with respect to the sides of the door 20. For example, door 20 can measure about 14⅜" from front to back and 17-¼" in length from side to side. The door should also be centered with respect to the monitor shelf. Preferably, the front of the door is about 4" from the front edge of the work surface.

The keyboard shelf is approximately 2½" below the bottom side of the work surface to accommodate a typical keyboard.

The monitor supporting shelf is typically angled at around 35° from the horizontal.

The door 20, even in its open position, can serve to minimize glare on the screen of the monitor.

The above embodiment is intended to be illustrative of the invention. Many variations of the above embodiment will be evident to one of ordinary skill in the art. Therefore, the appended claims are intended to define the scope of the invention.

What is claimed is:

1. A computer workstation comprising:

a desk having a top with an opening defined therein;

a keyboard shelf mounted in the desk below the top for movement between a retracted position, where the keyboard shelf is under the top, and an extended position, where the keyboard shelf is extended from the desk;

a monitor shelf mounted to the desk under the top;

a door disposed in the opening of the top for cooperating with the top to form a substantially flat work surface;

means for movably mounting the door with respect to the top;

linkage means connected to the keyboard shelf and the door for moving between a closed position where the door and top cooperate to form the work surface, and an open position where the opening in the top is revealed, in response to movement of the keyboard shelf between the retracted and extended positions, respectively, wherein the linkage means comprises linkage arms, each having a first end connected to the keyboard shelf and a second end for pushing open the door when the keyboard shelf is moved to the extended position, whereby the user of the workstation can work on the work surface when the keyboard shelf is in the retracted position and can view a computer monitor mounted on the monitor shelf through the opening when the keyboard shelf is in the extended position.

2. The workstation of claim 1 wherein the means for movably mounting the door comprises means for rotatably mounting the door.

3. The workstation of claim 1 wherein the linkage means comprises two elongate linkage arms, and means for rotatably mounting the arms at respective sides of the door.

4. The workstation of claim 3 wherein the linkage means further comprises two plates mounted to the keyboard shelf and having slots therein which receive the first end of each linkage arm, respectively.

5. The workstation of claim 1 wherein the monitor shelf is disposed at an angle relative to a horizontal plane.

6. A computer workstation comprising:

a desk having a top with an opening defined therein;

a keyboard shelf mounted in the desk below the top for movement between a retracted position where the keyboard shelf is under the top, and an extended position where the keyboard shelf is extended from the desk;

a monitor shelf mounted to the desk under the top;

a door disposed in the opening of the top for cooperating with the top to form a substantially flat work surface;

means for movably mounting the door with respect to the top;

linkage means connected to the keyboard shelf and the door for moving between a closed position where the door and top cooperate to form the work surface, and an open position where the opening in the top is revealed, in response to movement of the keyboard shelf between the retracted and extended positions, respectively, whereby the user of the workstation can work on the work surface when the keyboard shelf is in the retracted position and can view a computer monitor mounted on the monitor shelf through the opening when the keyboard shelf is in the extended position, wherein the linkage means comprises two elongate arms, and means for rotatably mounting the arms at respective sides of the door, and two plates mounted to the keyboard shelf and having slots therein, respectively, for receiving one end of each linkage arm respectively.

7. The workstation of claim 6 wherein the means for movably mounting the door comprises means for rotatably mounting the door.

8. The workstation of claim 6 wherein another end of each linkage arm is disposed in contact with the underside of the door for camming the door upward in response to extension of the keyboard shelf.

9. The workstation of claim 6 wherein the monitor shelf is disposed at an angle relative to a horizontal plane.

* * * * *